US007720429B2

(12) United States Patent
Lim

(10) Patent No.: US 7,720,429 B2
(45) Date of Patent: May 18, 2010

(54) IMAGE FORMING APPARATUS INCLUDING SHUTTER ARM UNIT

(75) Inventor: Kwang-taek Lim, Kwangmyung-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 701 days.

(21) Appl. No.: 11/595,930

(22) Filed: Nov. 13, 2006

(65) Prior Publication Data

US 2007/0147919 A1 Jun. 28, 2007

(30) Foreign Application Priority Data

Dec. 26, 2005 (KR) ..... 10-2005-0129504

(51) Int. Cl.
*B65H 3/46* (2006.01)
*B65H 3/56* (2006.01)

(52) U.S. Cl. ..... 399/388; 271/121; 271/124

(58) Field of Classification Search ..... 271/121, 271/124, 257

See application file for complete search history.

(56) References Cited

U.S. PATENT DOCUMENTS 5,316,285 A 5/1994 Olson et al.
6,135,444 A 10/2000 Padget
6,877,738 B2 * 4/2005 Sonoda et al. ..... 271/121
7,308,227 B2 * 12/2007 Ahn ..... 399/388
2007/0127972 A1 * 6/2007 Silverbrook et al. ..... 400/692

FOREIGN PATENT DOCUMENTS

EP 0 918 028 A1 5/1999
JP 61-69639 4/1986
JP 61-206760 9/1986
JP 1-236132 9/1989
JP 4-007262 1/1992
JP 04338044 A * 11/1992

OTHER PUBLICATIONS

Search Report issued on Apr. 4, 2007 by the European Patent Office for European Patent Application No. 06125877.8.

* cited by examiner

*Primary Examiner*—Daniel J Colilla
(74) *Attorney, Agent, or Firm*—Staas & Halsey LLP

(57) ABSTRACT

An image forming apparatus includes a printing unit and a shutter arm unit. The shutter arm unit includes a shutter arm that swings to first and second positions, and a stopper arm, connected to the shutter arm, which protrudes toward a transportation path when the shutter arm swings to the second position in which the stopper arm prevents extra sheets of recording media from moving along the transportation path. The force of the paper moving along the transportation path swings the shutter arm unit into the second position, a protrusion cam and an escape cam prevent an increase in the return load of the shutter arm, and a pair of ends of the shutter arm aligns the front end of the sheet of paper.

25 Claims, 11 Drawing Sheets

IMAGE FORMING APPARATUS INCLUDING SHUTTER ARM UNIT

CROSS-REFERENCE TO RELATED APPLICATIONS

This application claims the benefit of Korean Application No. 2005-129504, filed Dec. 26, 2005, in the Korean Intellectual Property Office, the disclosure of which is incorporated herein by reference.

BACKGROUND OF THE INVENTION

1. Field of the Invention

Aspects of the present invention relate to an image forming apparatus, and more particularly, to an image forming apparatus which prevents a multi-sheet feed along a transportation path.

2. Description of the Related Art

Generally, an image forming apparatus, such as, for example, a printer, a copier, a fax machine, or a multifunctional apparatus includes a printing unit which prints an image onto a recording medium and a transportation path which transports the recording medium inside the printing unit. This recording medium may be various different types of media, such as a sheet of paper, a sheet of photographic printing paper, OHP film, etc., and will be referred to as paper hereinafter, but is not limited to paper. Sheets of paper should be moved one by one through the printing unit during printing operations, from the time the sheets enter the printing unit until the time the sheets are discharged from the printing unit to a discharge tray. If two or more sheets of paper are moved through the printing unit simultaneously (a situation referred to as a multi-sheet feed), the extra sheets may cause a paper jam in the image forming apparatus, or may cause a printing defect in the images printed on the sheets of paper, such as by printing images intended to be printed on different sheets of paper onto the same sheet of paper.

An image forming apparatus of the related art may include a multi-sheet feed preventing unit which prevents several sheets of paper from being moved through the printer at the same time. Examples of multi-sheet feed preventing units are described below.

A knock up plate is disposed in a sheet-feeding cassette which stores the paper that is eventually supplied to the printing unit. The paper is stacked on the upper side of the knock up plate, and a knock up spring elastically biases the lower side of the knock up plate in an upwards direction. Sheets of paper stacked on the upper side of the knock up plate are picked up individually by a pick up roller, and then are supplied to the printing unit by a feed roller.

One example of a multi-sheet feed preventing unit includes finger members which are disposed at both sides of the knock up plate, such that the pick up roller picks up the sheets of paper individually (one by one). The finger members apply a transportation obstructing force on the sheets of paper by pressing both corners of the sheets of paper stacked on the knock up plate. The frictional force between the pick up roller and a top sheet of paper stacked on the knock up plate is greater than the frictional force between the top sheet of paper and a next sheet of paper stacked under the top sheet of paper. Furthermore, the frictional force between the pick up roller and a top sheet of paper stacked on the knock up plate is greater than the transportation obstructing force of the finger members. Thus, the frictional force generated by the pick up roller picks up the top sheet of paper, while the frictional force between the finger members and the sheets of paper prevents extra sheets of paper from being picked up, and the sheets are picked up individually.

A second example of a multi-sheet feed preventing unit includes a friction pad disposed on the upper side of the knock up plate which frictionally prevents two sheets of paper from being picked up simultaneously by the pick-up roller, when only two sheets of paper are stacked on the upper side of the knock up plate. In this second example, the friction pad is disposed at a position facing the pick up roller housed inside the frame of an image forming apparatus. The frictional force between the pick up roller and a top sheet of paper stacked on the knock up plate is greater than the frictional force between the top sheet of paper and the next sheet of paper stacked under the top sheet of paper. Furthermore, the frictional force between the pick up roller and a top sheet of paper stacked on the knock up plate is greater than the frictional force acting on the friction pad and the paper. Thus, the sheets of paper are picked up individually.

As described above, a sheet of paper picked up by the pick up roller is supplied to the printing unit by the feed roller. The sheet of paper is supplied to the printing unit along the transportation path, and an image is printed onto the sheet of paper. The sheet of paper with the printed image is transported along the transportation path and then discharged outside the image forming apparatus to a discharge tray. On the transportation path are rollers positioned at the entrance and exit of the printing unit and a guide member, positioned between the rollers, which guides the sheet of paper along the transportation path. The rollers contact each other at a roller portion where the rollers face each other, forming a nip which nips a sheet of paper between the two rollers, and the rollers include a guide member portion which connects the rollers. The multi-sheet feed preventing unit may be disposed at a position adjacent to the pick up roller, or may be disposed at any position along the transportation path. Although the various multi-sheet feed preventing units described above can prevent multiple sheets of paper from moving through the transportation path simultaneously, sometimes these various multi-sheet feed preventing units fail to prevent multi-sheet feeds. Thus, an improved multi-sheet feed preventing unit is necessary.

SUMMARY OF THE INVENTION

Aspects of the present invention provide an image forming apparatus which includes a multi-sheet feed preventing unit disposed at any position along a transportation path inside of the image forming apparatus.

Additional aspects and/or advantages of the invention will be set forth in part in the description which follows and, in part, will be obvious from the description, or may be learned by practice of the invention.

An aspect of the present invention provides an image forming apparatus including a printing unit which prints an image on a sheet of paper, wherein a transportation path of the sheet of paper is arranged between the entrance and exit of the printing unit, and a shutter arm unit which includes a shutter arm and a stopper arm. The shutter arm is biased on standby at a first position, and in standby one end of the shutter arm protrudes toward the transportation path. When a first sheet of paper moving along the transportation path contacts the front end of the sheet of paper, the shutter arm swings to a second position. A stopper arm disposed on the shutter arm prevents additional sheets from moving along the transportation path at the same time as the first sheet of paper by protruding toward the transportation path when the shutter arm swings to the second position and blocking the front ends of the additional sheets.

According to an aspect of the present invention, the stopper arm includes a free end which protrudes toward the transportation path at the second position, and a fixing end connected to the shutter arm by a hinge.

According to an aspect of the present invention, the shutter arm includes a protrusion cam which makes the free end protrude by pushing the stopper arm in one direction as the shutter arm swings to the second position.

According to an aspect of the present invention, the shutter arm includes an escape cam which retracts the free end from the transportation path by pushing the stopper arm in the other direction as the shutter arm returns to the first position.

According to an aspect of the present invention, the stopper arm rotates independent from the shutter arm before making contact with either the protrusion cam or the escape cam.

According to an aspect of the present invention, the shutter arm unit further includes a guide member which guides the sheet of paper along the transportation path, and a restriction groove formed in the guide member which opens toward the transportation path, wherein the stopper arm protrudes toward the transportation path through the restriction groove, and the restriction groove supports the stopper arm as the stopper arm blocks the front ends of sheets of paper moving simultaneously along the transportation path.

According to an aspect of the present invention, a pair of ends of the shutter arm, spaced apart from each other, are integrally formed together and face a direction perpendicular to the transportation direction of the paper, and may align the front end of the sheet of paper by contacting both sides of the paper as the paper moves along the transportation path.

According to an aspect of the present invention, the shutter arm is elastically biased to elastically return to the first position when the shutter arm no longer contacts the paper as the image forming apparatus discharges the paper.

According to an aspect of the present invention, the shutter arm unit further includes a sensing portion which detects the front end of the sheet of paper moving along the transportation path by sensing a swing position of the shutter arm.

According to an aspect of the present invention, the sensing portion includes a sensor arm integrally formed with the shutter arm which swings with the shutter arm, and an optical sensor, disposed in the swing path of the sensor arm, which senses the swing position of the sensor arm.

Another aspect of the present invention provides an image forming apparatus including a printing unit which prints an image onto a sheet of paper, wherein a transportation path of the sheet of paper is arranged between the entrance and exit of the printing unit, and a shutter arm unit. The shutter arm unit includes one roller out of a pair of rollers which transport the sheet of paper by forming a nip in the transportation path, a shutter arm assembled so as to freely rotate around a rotation shaft of the roller, wherein the shutter arm is elastically biased at a first or "standby" position when one end of the shutter arm protrudes toward the transportation path, is pushed by the front end of the sheet of paper as the sheet of paper passes through the nip, and swings to a second position after the sheet of paper passes through the nip, and a stopper arm formed on the shutter arm and positioned upstream of the nip, which blocks the front ends of extra sheets of paper moving simultaneously along the transportation path by protruding toward the transportation path when the shutter arm swings to the second position.

According to another aspect of the present invention, the stopper arm may include a free end which protrudes toward the transportation path at the second position, and a fixing end connected to the shutter arm by a hinge.

According to another aspect of the present invention, the shutter arm may include a protrusion cam which makes the free end protrude by pushing the stopper arm towards the transportation path as the shutter arm swings to the second position.

According to another aspect of the present invention, the shutter arm may include an escape cam which retracts the free end from the transportation path by pushing the stopper arm away from the transportation path as the shutter arm returns to the first position.

According to another aspect of the present invention, the stopper arm rotates freely around a hinge before making contact with either the protrusion cam or the escape cam.

According to another aspect of the present invention, the shutter arm unit further includes a guide member which guides the sheet of paper, and a restriction groove formed in the guide member which opens toward the transportation path, wherein the stopper arm protrudes toward the transportation path through the restriction groove, and the stopper arm blocks front ends of extra sheets of paper moving simultaneously with the sheet of paper along the transportation path by being supported in contact with the restriction groove.

According to another aspect of the present invention, the shutter arm unit further includes a pair of bosses, elastically biased toward the nip, which support both ends of the rotation shaft of the roller.

According to another aspect of the present invention, the shutter arm unit further includes an escape member which retracts the rotation shaft of the roller away from the nip.

According to another aspect of the present invention, the image forming apparatus further includes a body in which the printing unit is disposed, a door which opens and closes an area of the body near where the printing unit is disposed, a sheet-feeding cassette which is attachable to and detachable from the body and stores sheets of paper, and an escape member which contacts either of the sheet-feeding cassette or the door, and pops loose the rotation shaft of the roller when either the sheet-feeding cassette and/or the door is separated from the body.

BRIEF DESCRIPTION OF THE DRAWINGS

These and/or other aspects and advantages of the invention will become more apparent and more readily appreciated from the following description of the embodiments, taken in conjunction with the accompanying drawings of which.

DETAILED DESCRIPTION OF THE EMBODIMENTS

Figure 1:
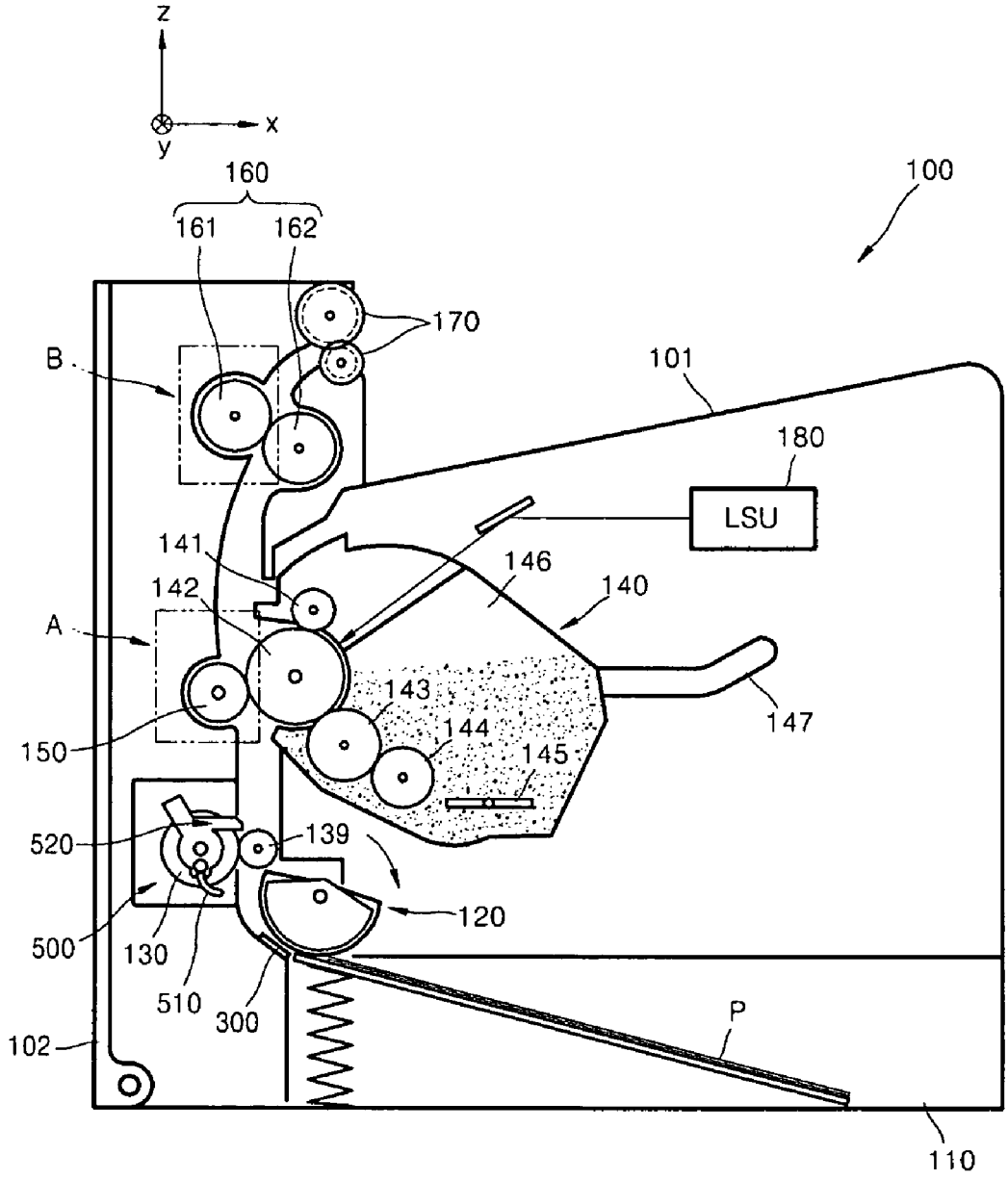
FIG. 1 is a side cross-sectional view which illustrates a main part of an image forming apparatus according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 is a side cross-sectional view which illustrates a main part of an image forming apparatus 100 according to an embodiment of the present invention. The image forming apparatus 100 includes a printing unit (not shown), a body 101, a sheet-feeding cassette 110, a door 102, a pick up roller 120, and a shutter arm unit 500. The printing unit and the door 102 are disposed in the body 101. The door 102 is connected to a side of the body 101 by a hinge, and opens and closes the body 101 to allow access to the printing unit and the transportation path of paper P. The printing unit which prints an image on paper P includes a light-scanning unit 180, a developing cartridge 140, and a fixer 160.

The light-scanning unit 180 scans light corresponding to image information onto a photosensitive drum 142 and forms an electrostatic latent image on an outer circumferential surface of the photosensitive drum 142. Although not shown, the light-scanning unit 180 includes a light source which irradiates a laser beam and a beam deflector which deflects the laser beam irradiated from the light source.

The developing cartridge 140 is detachably mounted inside the body 101. The developing cartridge 140 includes a charging roller 141, a photosensitive drum 142, a developing roller 143, a supply roller 144, an agitator 145, and a toner storage 146. According to another embodiment of the present invention, the photosensitive drum 142 and the charging roller 141 may be disposed outside the developing cartridge 140. The toner storage 146 stores toner. The developing cartridge 140 is replaced when the toner stored in the toner storage 146 is exhausted. A user mounts the developing cartridge 140 in the body 101 by pushing a handle 147 of the developing cartridge 140 in a negative direction of the x-axis, as shown in FIG. 1. The developing cartridge 140 is separated from the body 101 by pulling the handle 147 in a positive direction of the x-axis.

The photosensitive drum 142 is positioned so that a part of the outer circumferential surface of the drum 142 is exposed out of the toner storage 146, and the photosensitive drum 142 rotates in a predetermined direction. The outer circumferential surface of the photosensitive drum 142 is coated with a light-conductive material layer by a method such as vapor deposition. The charging roller 141 charges the photosensitive drum 142 to a predetermined electric potential. An electrostatic latent image, corresponding to an image which is to be printed, is formed on the outer circumferential surface of the photosensitive drum 142 by the light irradiated from the light-scanning unit 180.

Solid powder toner is disposed on the surface of the developing roller 143. The developing roller 143 transfers the toner onto the electrostatic latent image formed onto the photosensitive drum 142, thereby developing the electrostatic latent image into a toner image. A developing bias voltage which supplies the toner to the photosensitive drum 142 is applied to the developing roller 143. Then, the developing roller 143 and the outer circumferential surface of the photosensitive drum 142 contact each other to form a developing nip, or alternatively are spaced apart from each other to form a developing gap. The developing nip or the developing gap should be uniformly formed along an axial direction of the developing roller 143 and the photosensitive drum 142. To develop the toner image, the toner transferred from the developing roller 143 moves through the developing nip or the developing gap to the photosensitive drum 142 by the developing voltage bias.

The toner supplied by the supply roller 144 is stuck onto the developing roller 143. The agitator 145 constantly mixes the toner to prevent the toner in the toner storage 146 from hardening, and conveys the toner to the supply roller 144.

A transfer roller 150 is positioned to face the outer circumferential surface of the photosensitive drum 142. To transfer the toner image developed on the photosensitive drum 142 to the paper P, a transfer bias voltage which has an opposite polarity to the polarity of the toner image is applied to the transfer roller 150. Then, the toner image is transferred onto the paper P by a combination of electrostatic force and mechanical contact pressure generated between the photosensitive drum 142 and the transfer roller 150.

The fixer 160 includes a heating roller 161 and a pressing roller 162 facing each other. The fixer 160 fixes the toner image onto the paper P by applying heat from the heating roller 161 and pressure from the pressing roller 162 to the paper P.

After the fixer 160 fixes the toner image onto the paper P, the sheet-discharging roller 170 discharges the paper P with the fixed image outside the image forming apparatus 100. The paper P discharged from the image forming apparatus 100 is stacked onto a discharge tray (not shown).

The transportation path of the paper P will be described below. The image forming apparatus 100 includes the sheet-feeding cassette 110 where the paper P is stacked. The pick up roller 120 picks up individual sheets of paper P stacked onto the sheet-feeding cassette 110 and pulls the individual sheet of paper P up along the transportation path. A pair of rollers 130 and 139, facing each other and forming a nip, then transports the picked up paper P toward the developing cartridge 140. When the paper P passes between the photosensitive drum 142 and the transfer roller 150, the toner image is transferred onto the paper P and fixed by the heat and pressure of the fixer 160. The paper P with the fixed image is finally discharged outside the image forming apparatus 100 by the sheet-discharging roller 170.

The image forming apparatus 100 described above and shown in FIG. 1 is a black and white electro-photographic image forming apparatus. However, the image forming apparatus 100 according to aspects of the present invention may instead be another type of image forming apparatus, such as a color electro-photographic image forming apparatus or an inkjet image forming apparatus.

A shutter arm unit 500 includes a shutter arm 520 and a stopper arm 510.

Figure 2:
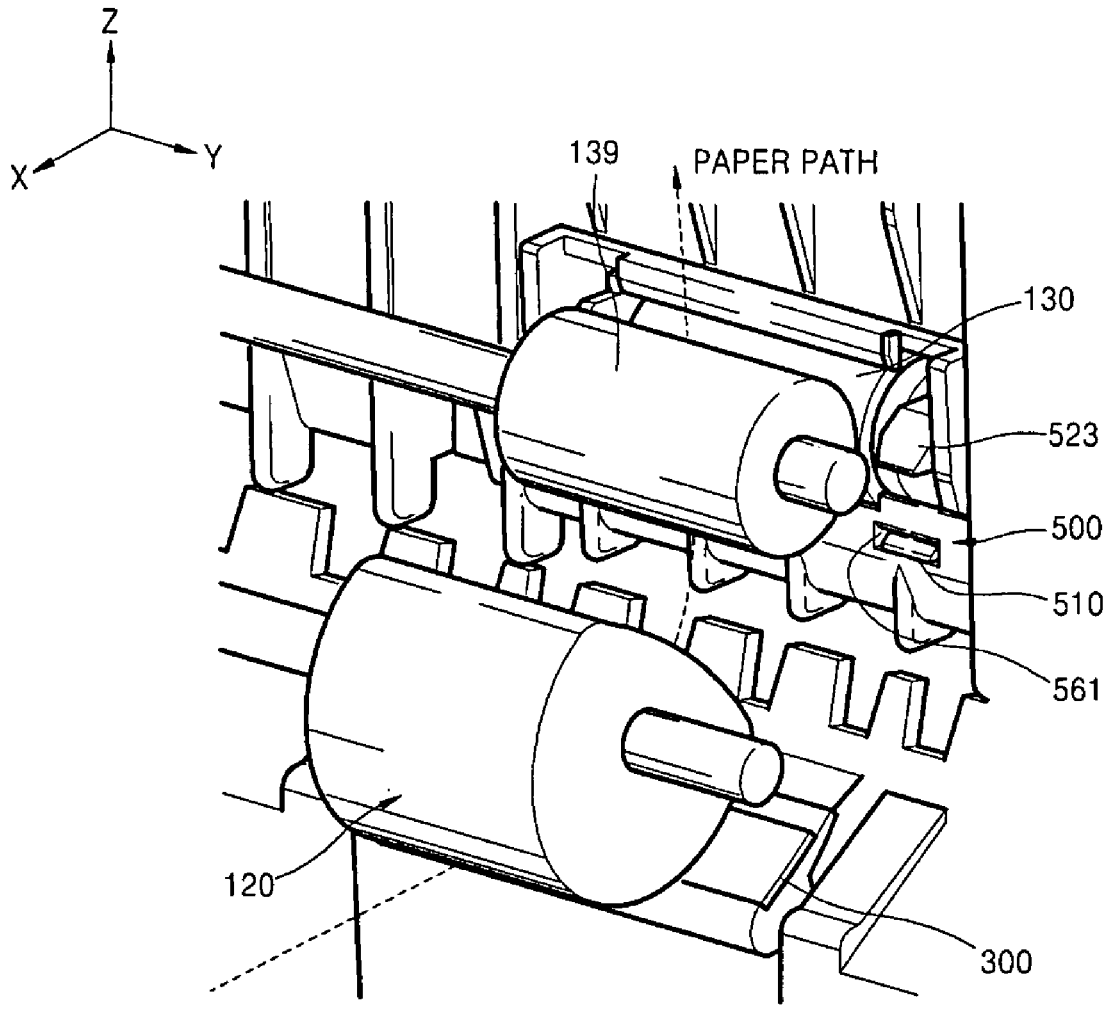
FIG. 2 is a perspective view which illustrates the installation of the shutter arm unit shown in FIG. 1.

The shutter arm 520 swings back and forth between first and second positions. In the first position, the shutter arm 520 is in a standby position, with one end 523 of the shutter arm 520 protruding toward the transportation path, as shown in FIGS. 1 and 2. As the sheet of paper P moves along the transportation path, a front end of the sheet of paper P pushes the end 523 of the shutter arm 520 and thus swings the shutter arm unit 500 to the second position due to the contact force of the front end of the sheet of paper P against the shutter arm 520.

The stopper arm 510 is formed together with the shutter arm 520. Since the stopper arm 510 is formed together with the shutter arm 520, the stopper arm 510 and shutter arm 520 are positioned so that when the shutter arm 520 protrudes into the transportation path, the stopper arm retracts from the transportation path, and vice versa. Thus, the stopper arm 510 stays in a retracted position as long as the shutter arm 520 stays on standby at the first position. The stopper arm 510 protrudes toward the transportation path through a restriction groove 561 and blocks the front ends of extra sheets of paper moving simultaneously with the sheet of paper P along the transportation path when the shutter arm 520 swings to the second position. The swinging positions of the shutter arm 520 and the stopper arm 510 will be described later. The stopper arm 510 and shutter arm 520 do not have to be integrally formed together, and instead may be connected by any number of connecting devices, such as wires, rods, etc.

A friction pad 300 helps prevent extra sheets of paper moving simultaneously with the sheet of paper P along the transportation path from moving past the pick up roller 120 to the rollers 130 and 139. The function of the friction pad 300 will be described in detail later.

Components inside of the image forming apparatus are located either "upstream" or "downstream" of each other along the transportation path. "Downstream" movement of the paper P is movement along the transportation path towards the discharge tray, and "upstream" movement is movement away from the discharge tray towards the sheet-feeding cassette 110. For example, the shutter arm unit 500 is positioned downstream of the pick up roller 120. However, the shutter arm unit 500 is not limited to the position shown in FIG. 2, and thus the shutter arm unit 500 may be positioned at a position A where the transfer roller 150 is disposed, a position B where the fixer 160 is disposed, a position between the positions A and B, i.e., between the transfer roller 150 and the fixer 160, or a position downstream of B, i.e., between the fixer 160 and the sheet-discharging roller 170.

Figure 3:
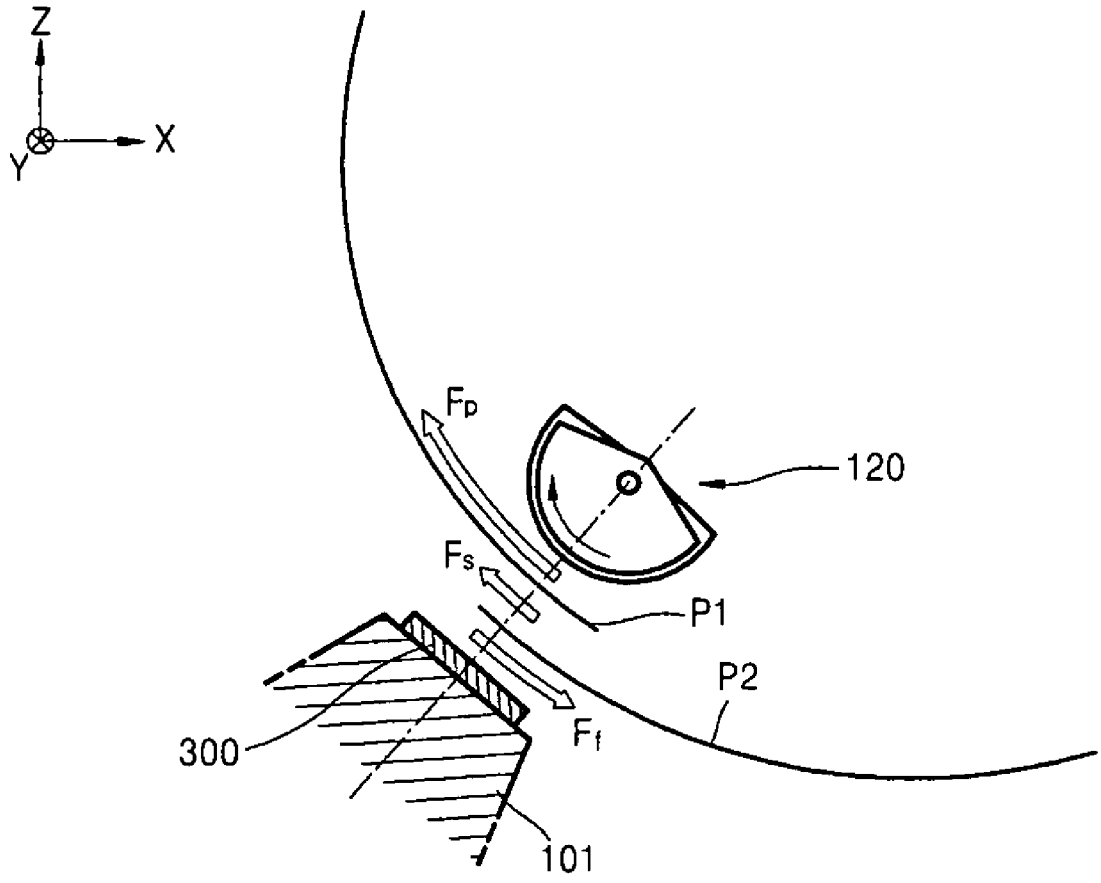
FIG. 3 is a cross-sectional view which explains the function of a friction pad shown in FIG. 1.

FIG. 3 is a cross-sectional view which explains the function of the friction pad 300 shown in FIG. 1. The pick up roller 120 and the friction pad are shown in FIG. 3. Although the pick up roller 120, the friction pad 300, a first sheet of paper P1 and a second sheet of paper P2 are illustrated as being separated from one another in FIG. 3, the friction pad 300, the first sheet of paper P1 and the second sheet of paper P2 can all actually contact each other when the pick up roller 120 picks up the first sheet of paper P1. The friction pad 300 is disposed downstream of the sheet-feeding cassette 110 in the body 101 of the image forming apparatus 100. Since the friction pad 300 and the outer circumference of the pick up roller 120 are elastically pressed together, a normal force acts on the outer circumference of the pick up roller 120, the first paper P1, the second paper P2, and the friction pad 300. The normal force generates frictional forces Fp, Fs, and Ff. The frictional force Fp acts between the pick up roller 120 and the first sheet of paper P1. The frictional force Fs acts between the first sheet of paper P1 and the second sheet of paper P2. The frictional force Ff acts between the second sheet of paper P2 and the friction pad 300.

Since the normal force generated by the elastic compression between the friction pad 300 and the pick up roller 120 is constant, the magnitudes of the frictional forces Fp, Fs, and Ff vary according to the specific coefficients of friction possessed by the frictional pad 300, the first paper P1 and the second paper P2, and the pick up roller 120. By properly adjusting the coefficient of friction of the outer circumferential surface of the pick up roller 120 and the surface of the friction pad 300, it is possible to make the magnitude of Fp sufficiently larger than the magnitude of Fs so that the pick up roller 120 frictionally picks up the first sheet of paper P1 due to the large frictional force Fp, while the friction pad frictionally prevents the second sheet of paper P2 from moving with the first sheet of paper P1. Thus, when the pick up roller 120 rotates, only the first sheet of paper P1 is picked up by friction, and the second sheet of paper P2 is not picked up by friction.

However, when an unexpected external force is applied to the image forming apparatus, such as a jolt or bump, or when the coefficients of friction for the pick up roller 120, first sheet of paper P1, second sheet of paper P2, and/or friction pad 300 change, the largest frictional force and the smallest frictional force may change, and this may cause a transportation failure, i.e., a multi-sheet feed, in which the first sheet of paper P1 and the second sheet of paper P2 move simultaneously along the transportation path. The shutter arm unit 500 is disposed downstream of the pick up roller 120 and prevents multi-sheet feeds from occurring when the friction pad 300 cannot.

Figure 4:
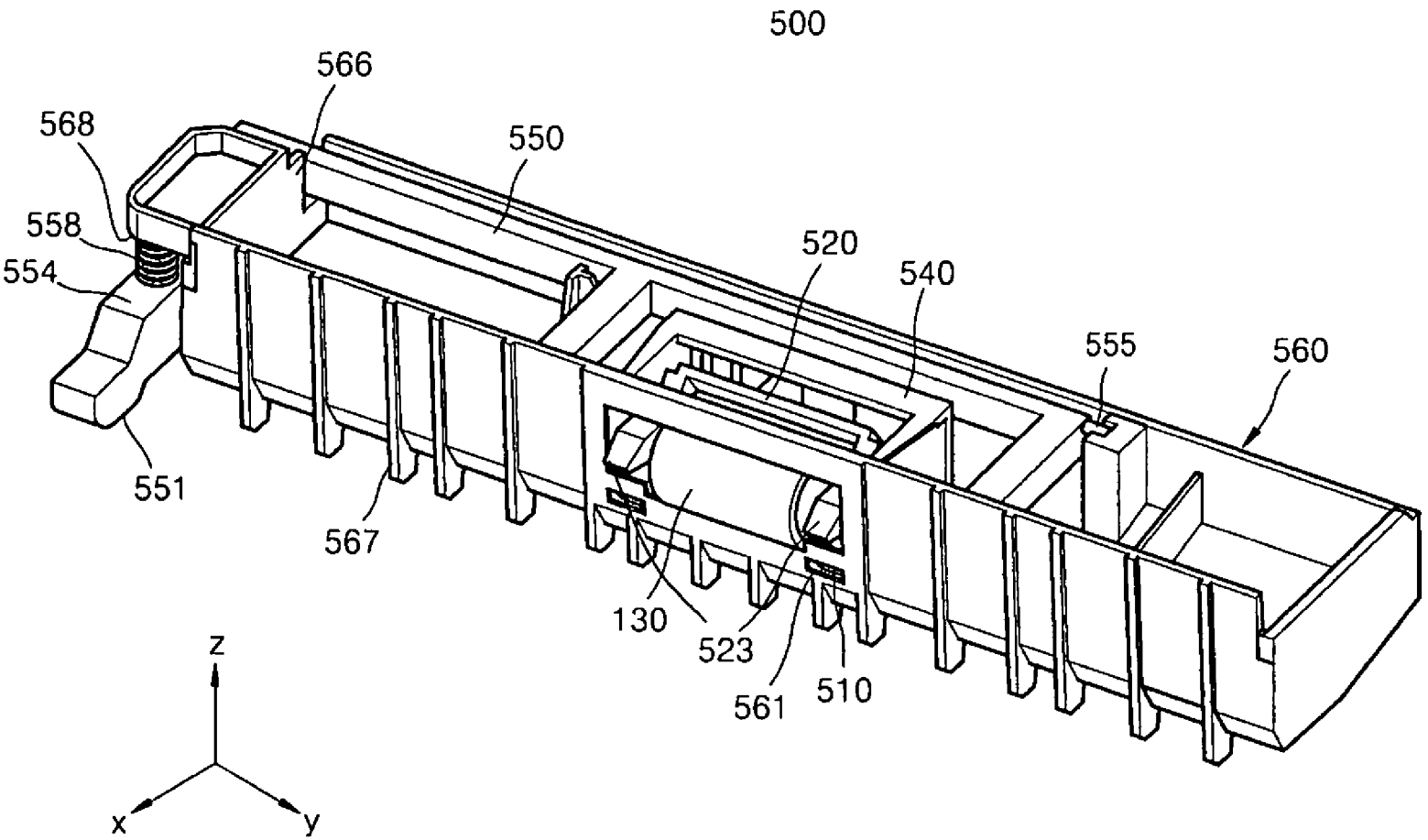
FIG. 4 is an assembled perspective view of the shutter arm unit shown in FIG. 1.
Figure 5:
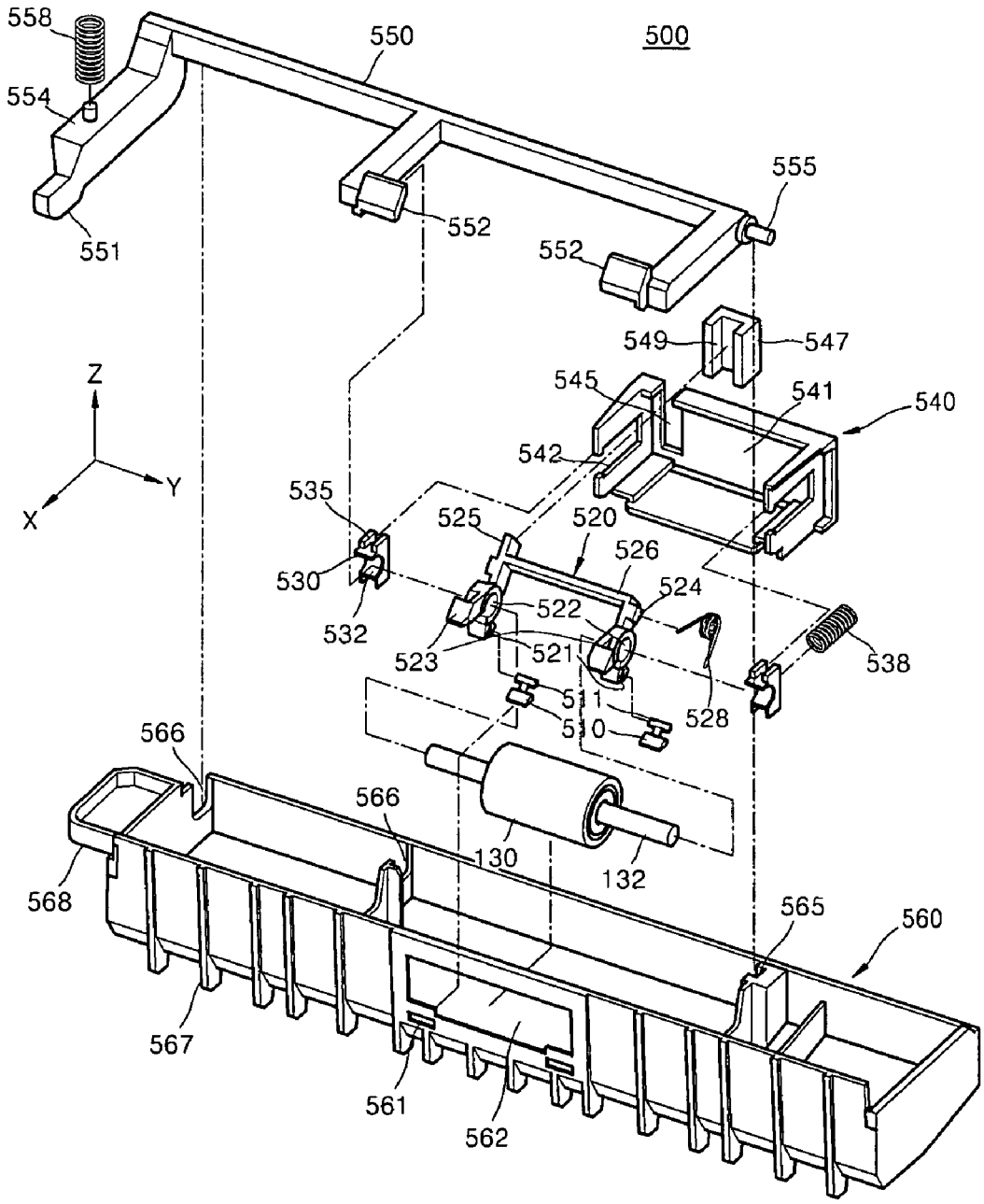
FIG. 5 is an exploded perspective view of the shutter arm unit shown in FIG. 1.

FIG. 4 is an assembled perspective view of the shutter arm unit 500 according to an embodiment of the present invention. FIG. 5 is an exploded perspective view of the shutter arm unit 500 and FIG. 6 is a perspective view which illustrates an assembly of the shutter arm 520 and roller 130.

Figure 6:
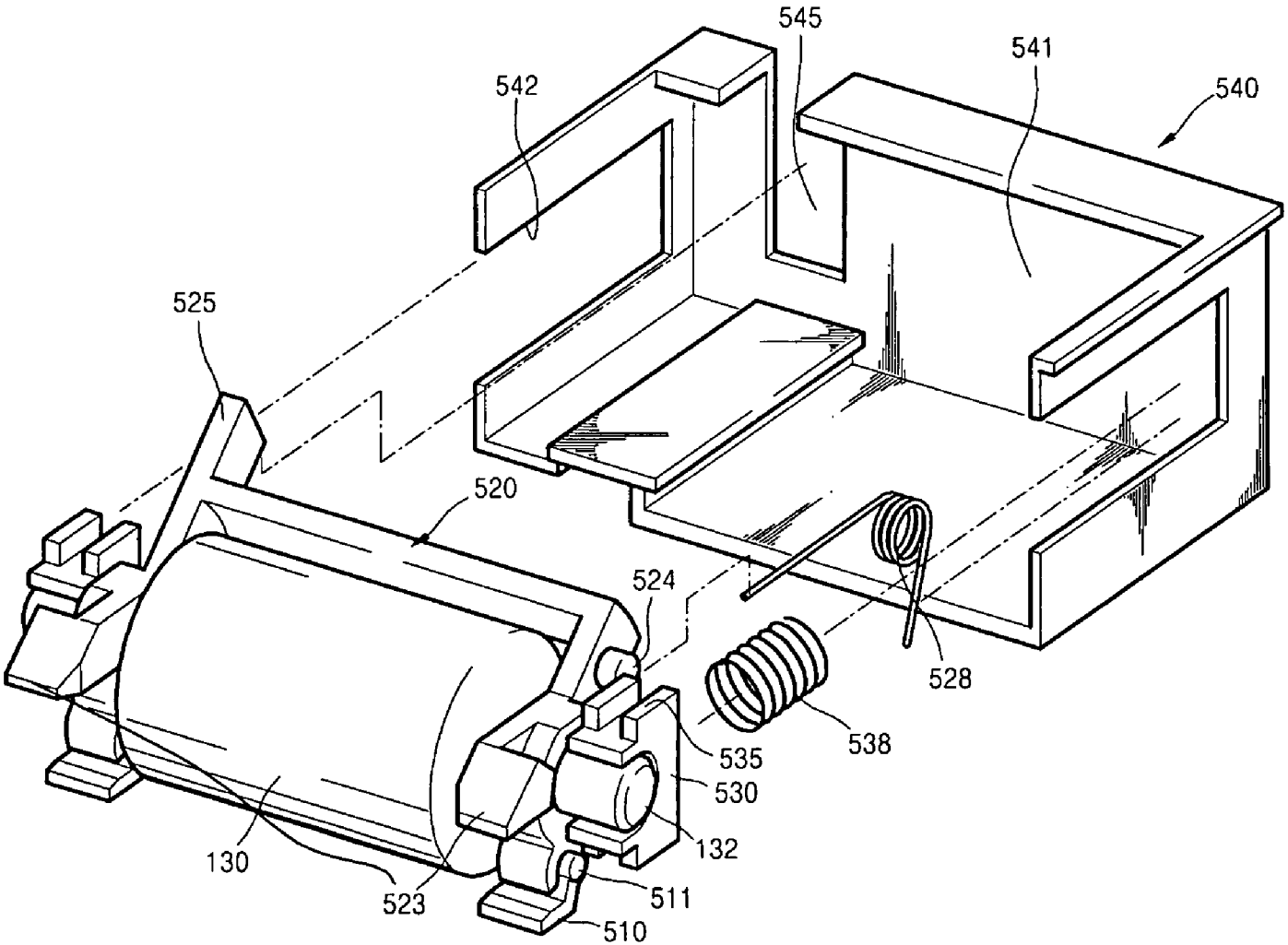
FIG. 6 is a perspective view which illustrates an assembly of the shutter arm and the roller shown in FIG. 1.

Referring to FIGS. 4 through 6, the shutter arm unit 500 includes the shutter arm 520 and the stopper arm 510.

Figure 7:
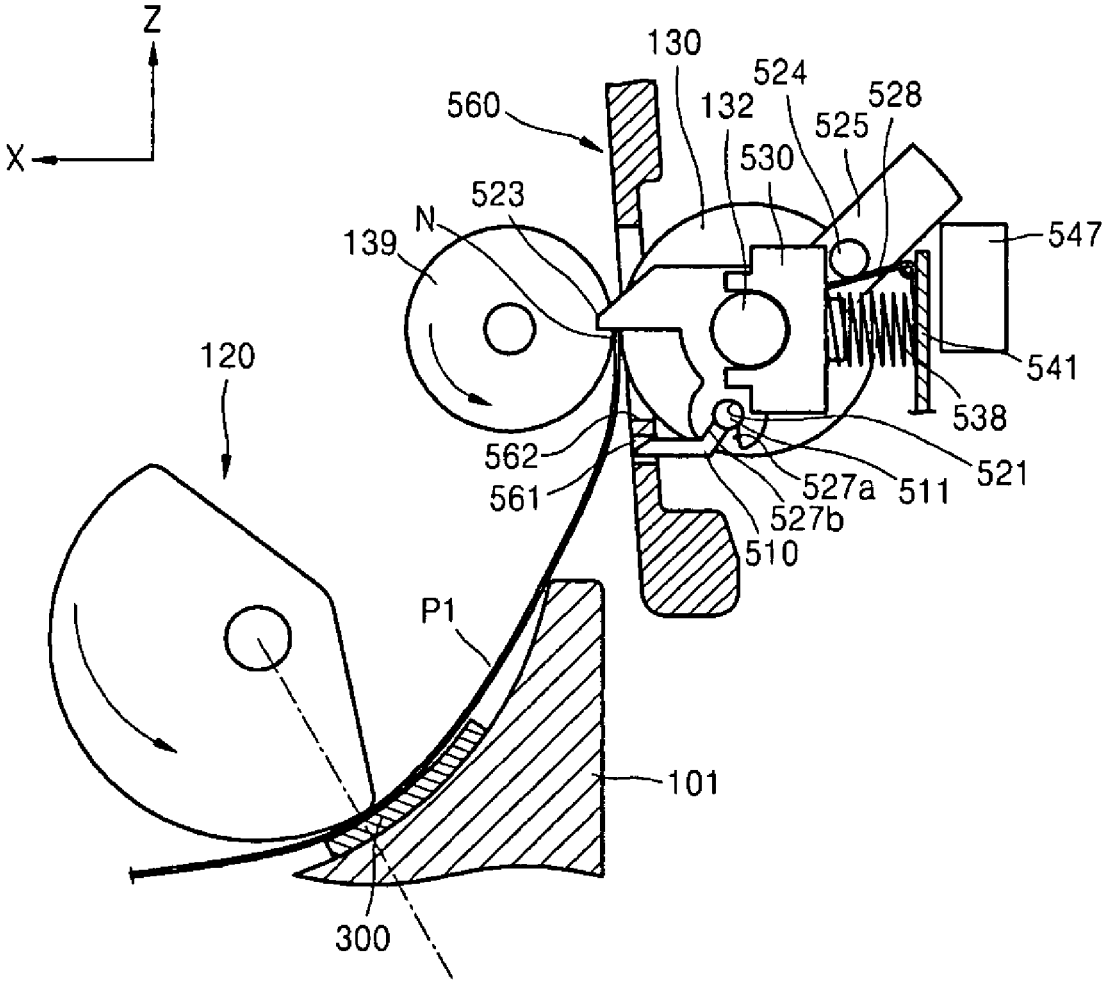
FIGS. 7 through 9 are cross-sectional views which explain the operations of the shutter arm and the stopper arm shown in FIG. 2.

The shutter arm 520 includes a hinge hole 521, a rotation shaft hole 522, one end 523 which contacts the front end of the sheet of paper being moved along the transportation path, a hook 524, a sensor arm 525, a link 526, a protrusion cam 527*a* (see FIG. 7), and an escape cam 527*b* (see FIG. 7). When the shutter arm 520 swings to the second position, a free end (not shown) of the stopper arm 510 which is connected to the shutter arm by a fixing end (not shown), which in turn is connected to the shutter arm 520 by a hinge 511, protrudes toward the transportation path. The free end (not shown) of the stopper arm 510 slides through the restriction groove 561 formed into the guide member 560 and protrudes toward the transportation path to block the front ends of excess sheets from moving simultaneously with the sheet of paper P along the transportation path. The hinge 511 is disposed at the fixing end (not shown) of the stopper arm 510, and rotates freely in the hinge hole 521 of the shutter arm 520.

A rotation shaft 132 of the roller 130 is inserted into the rotation shaft hole 522. However, a separate rotation shaft (not shown) may instead be used to bias the roller 130 into position. The shutter arm 520 rotates around the rotation shaft 132 of the roller 130 as the shutter arm 520 between the first and second positions. The shutter arm unit 500 is not limited to the position shown in the drawings, and may alternatively be disposed at any position on the transportation path of paper. When the shutter arm unit 500 is disposed downstream of the pick up roller 120 (see FIG. 1), the shutter arm unit 500 includes the roller 130, and the shutter arm 500 is freely rotatively inserted into the rotation shaft 132 of the roller 130.

Although not shown, when the shutter arm unit 500 is disposed at the position represented by the box "A" (see FIG. 1) of the transfer roller 150, the shutter arm unit 500 includes the transfer roller 150 instead of the roller 130, and the shutter arm 520 is freely rotatively inserted into the rotation shaft (not shown) of the transfer roller 150.

Although not shown, when the shutter arm unit 500 is disposed at the position represented by the box "B" (see FIG. 1) of the fixer 160, the shutter arm unit 500 includes the heating roller 161 instead of the roller 130, and the shutter arm 520 is freely rotatively inserted into the rotation shaft (not shown) of the heating roller 161.

Although not shown, when the shutter arm unit 500 is disposed between the positions represented by the boxes "A" and "B" (see FIG. 1), i.e., between the transfer roller 150 and the fixer 160, the shutter arm unit 500 does not include the roller 130, and the shutter arm 520 is freely rotatively inserted into a separately installed additional rotation shaft (not shown).

Although not shown, when the shutter arm unit 500 is disposed between the fixer 160 and the sheet-discharging roller 170 (see FIG. 1), the shutter arm unit 500 does not include the roller 130, and the shutter arm 520 is freely rotatively inserted into a separately installed additional rotation shaft (not shown).

When the sheet of paper P moves downstream along the transportation path, the front, or leading, end of the sheet of paper P contacts the end 523 of the shutter arm 520 because the shutter arm 520 is elastically biased into the first, or standby, position.

The shutter arm 520 is elastically biased in the standby position by a torsion spring 528 which elastically returns the shutter arm 520 to the first position after the sheet of paper P passes the shutter arm unit 500. Both ends of the torsion spring 528 are supported by a hook 524 at the shutter arm 520 and a housing body 541.

A sensing portion (not shown) senses a swing position of the shutter arm 520 and thus detects when the front end of the sheet of paper P is moving past the shutter arm 520. The sensing portion may include a sensor arm 525 and an optical sensor 547. Since the sensor arm 525 is integrally arranged with the shutter arm 520, the sensor arm 525 has the same swing angle as that of the shutter arm 520. The sensor arm 525 penetrates a sensor arm groove 545 formed in the housing 540, and is inserted into a sensor groove 549 disposed at the optical sensor 547. Although not shown, the optical sensor 547 includes a light-emitting portion and a light receiving portion, and detects the swing position of the sensor arm 525 by radiating light onto the sensor arm 525 and perceiving the difference in a quantity of the light reflected by the sensor arm 525.

The shutter arm 520 has a pair of ends 523 spaced apart from each other and integrally connected to each other by a link 526. The pair of ends 523 of the shutter arm 520 is elastically biased along a direction perpendicular to the transportation direction of paper. The pair of ends 523 of the shutter arm 520 functions to align the front end of the paper P by restraining the right and left sides of the front end of the sheet of paper P at the same level position with the same force.

As the shutter arm 520 swings to the second position, the protrusion cam 527*a* pushes the stopper arm 510 in a clockwise direction (see FIG. 8) and forces the stopper arm 510 to protrude toward the transportation path.

As the shutter arm 520 elastically returns to the standby position, the escape cam 527*b* pushes the stopper arm 510 in a counter-clockwise direction (see FIG. 9) and forces the stopper arm 510 to retract from the transportation path.

The stopper arm 510 swings freely around the hinge 511 of the shutter arm 520. However, the protrusion cam 527*a* and the escape cam 527*b* limit the range in which the stopper arm 510 can swing to the space between the protrusion cam 527*a* and the escape cam 527*b*.

When the protrusion cam 527*a* starts contacting the stopper arm 510 as a result of the sheet of paper P pushing against the shutter arm 520, the stopper arm 510 protrudes toward the transportation path. Since the sheet of paper P pushing against the shutter arm 520 supplies the force which causes the stopper arm 510 to protrude towards the transportation path, the protruding force of the stopper arm 510 toward the transportation path is equivalent to the normal force of the sheet of paper pushing against the shutter arm 520. When the sheet of paper P passes the shutter arm 520 as the sheet of paper P moves downstream, and the shutter arm 520 elastically returns to the standby position via the torsion spring 528, the protrusion cam 527*a* does not create any resistance against the elastic movement of shutter arm 520 back to a standby position. The protrusion cam 527*a* does not cause resistance because the stopper arm 510 is positioned between the protrusion cam 527*a* and the escape cam 527*b* and swings freely as the shutter arm 520 elastically returns to the standby position. Thus, the return load of the shutter arm 520 is not increased by the protrusion cam 527*a*.

On the other hand, when the sheet of paper P passes the shutter arm 520 as the sheet of paper P moves downstream, and the shutter arm 520 elastically returns to the standby position via the torsion spring 528, the escape cam 527*b* contacts the stopper arm 510 and causes resistance against the shutter arm 520. The escape force of the stopper arm 510 is equivalent to the elastic force of the torsion spring 528. When the escape cam 527*b* starts contacting the stopper arm 510, the return load of the shutter arm 520 increases, causing a resistance force against the elastic force of the torsion spring 528 and potentially preventing the shutter arm 520 from fully returning to the standby position. This return failure results in the shutter arm 520 returning to a position short of the standby position, which in turn results in the shutter arm 520 not being able to contact sheets of paper moving along the transportation path after the sheet of paper P. However, by spacing the escape cam 527*b* sufficiently apart from the protrusion cam 527*a*, and positioning the escape cam 527*b* so that the escape cam does not, start contacting the stopper arm 510 until the shutter arm 520 is almost adjacent to the standby position, this return failure can be avoided. Thus, even though the escape cam 527*b* increases the return load of the shutter arm 520, the return load on the shutter arm 520 caused by the escape cam 527*b* is not large enough to lead to the return failure of the shutter arm 520. It is understood that the proximity of the protrusion cam 527*a* to the escape cam 527*b*, as well as the position of the shutter arm 520 to the standby position, is adjustable.

The shutter arm unit 500 further includes a guide member 560 and a restriction groove 561. The guide member 560 forms a part of the transportation path and guides the sheet of paper P along the transportation path. The restriction groove 561 is formed in the guide member 560 and opens toward the transportation path. The stopper arm 510 protrudes through the restriction groove 561. An upper boundary of the restriction groove 561, integrally formed into the shutter arm unit 500, supports the stopper arm 510 protruding through the restriction groove 561 as the stopper arm 510 blocks the front ends of a plurality of excess sheets moving simultaneously with the sheet of paper P along the transportation path.

Figure 8:
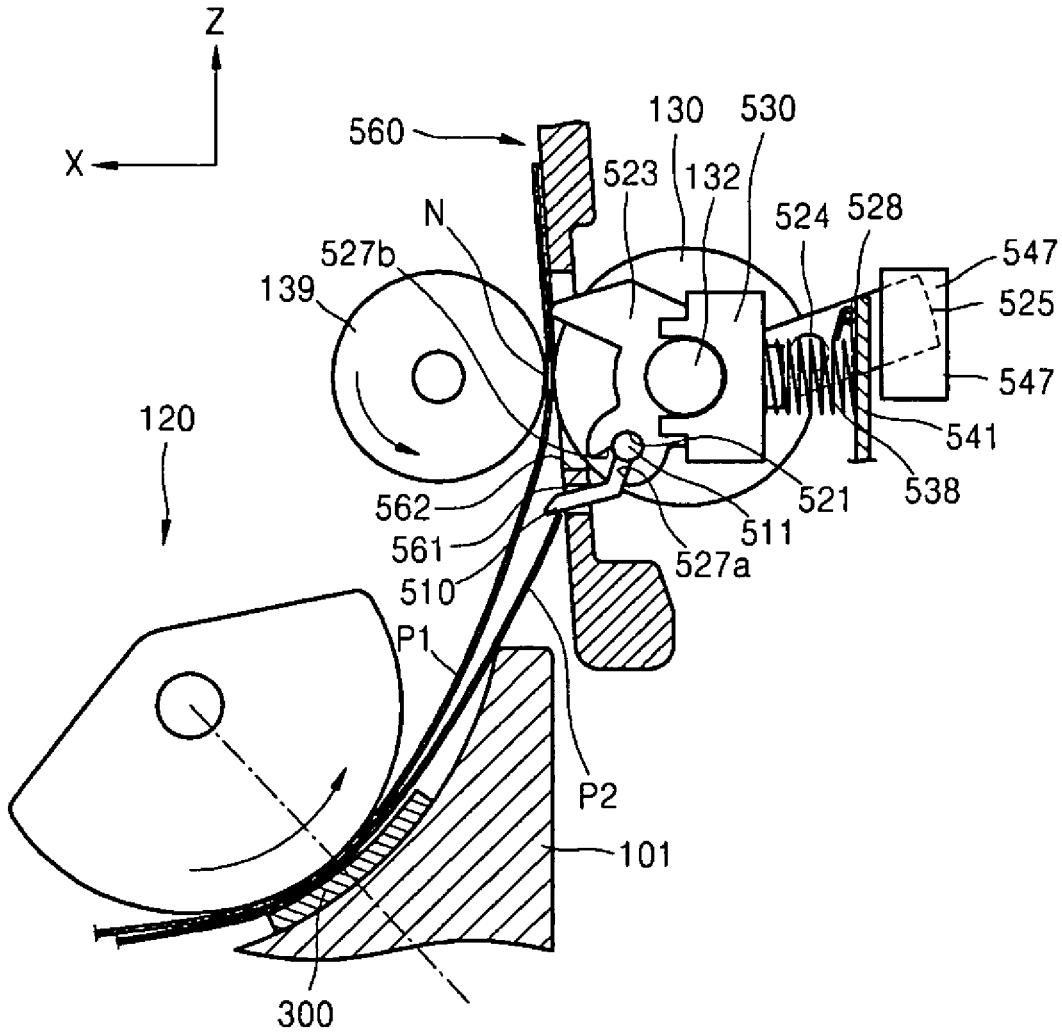
Figure 9:
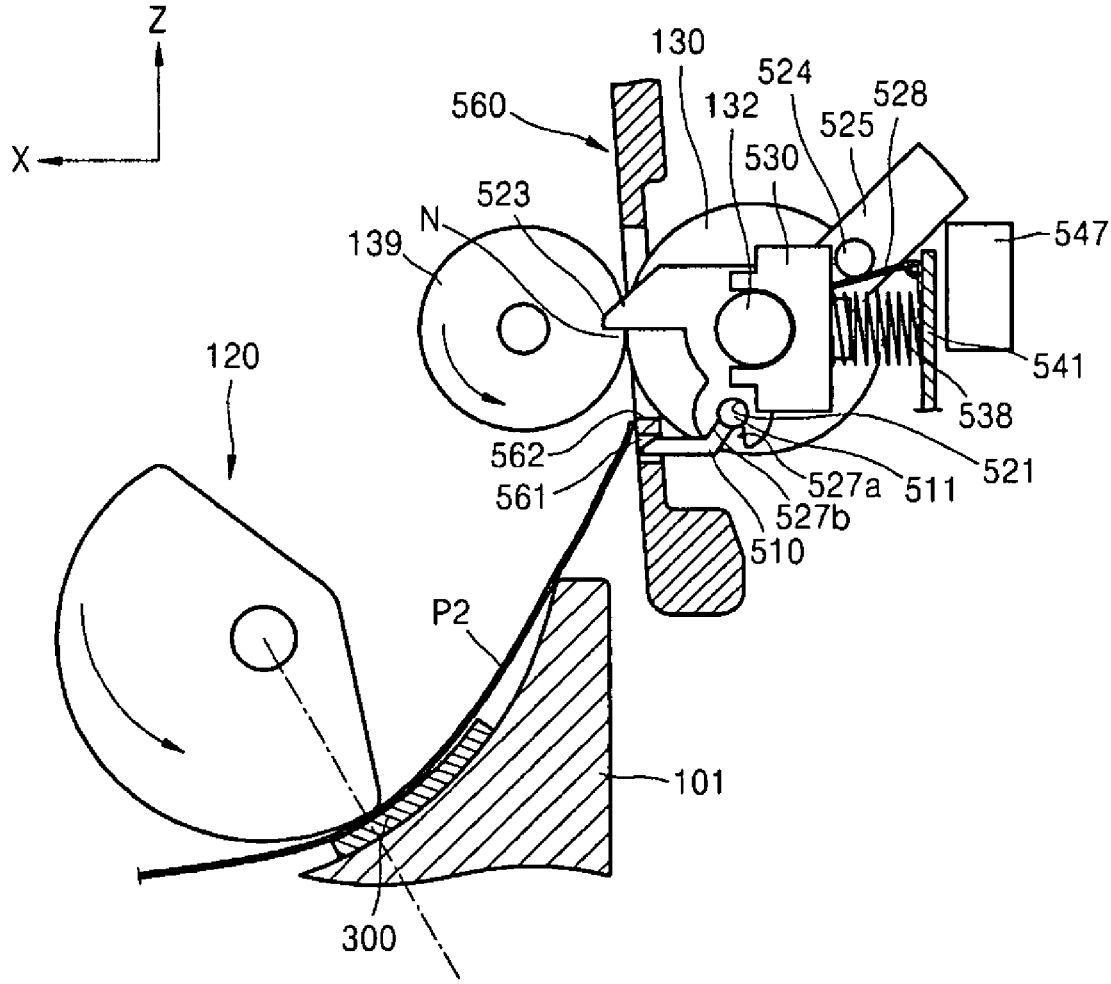

When the shutter arm unit 500 is positioned along the transportation path in a position which includes the roller 130 (see FIG. 1), the shutter arm unit 500 may further include a boss 530 and an escape member 550. Referring to FIGS. 7 through 9, the rollers 130 and 139 are positioned to contact or nearly contact each other at a nip N along the transportation path. The rollers 130 and 139 engage sheets of paper at the nip N. With respect to the relative position of the stopper arm 510 and the nip N, the stopper arm 510 is arranged upstream of the nip N. The stopper arm 510 blocks excess sheets of paper moving simultaneously with the sheet of paper P from entering the nip N.

Referring to FIGS. 4 through 6, a pair of bosses 530 is elastically biased toward the nip N. The bosses support both ends of the rotation shaft 132 of the roller 130. The boss 530 includes a boss hole 532, a boss rail 535, and a boss spring 538. The boss hole 532 rotatively supports the rotation shaft 132 of the roller 130. The boss rail 535 is inserted into a boss rail guide 542 disposed in the housing 540, and slides in a direction along the x-axis (see FIG. 5). One end of the boss spring 538 is connected to one of the bosses 530, and the other end of the boss spring 538 presses against the housing body 541. The boss spring 538 elastically presses a boss 530 into the roller 130, and the roller 130 elastically presses against the roller 139, generating an adhesion force between the rollers 130 and 139 at the nip N which engages the sheet of paper P.

To prevent a paper jam or any interference between constitutional parts of the shutter arm unit 500 when attaching or detaching the shutter arm unit 500 from the image forming apparatus 100, the pair of rollers 130 and 139 should be spaced apart from each other, and the shutter arm 520 and the stopper arm 510 need to retract away from the transportation path. To accomplish these purposes, the escape member 550 is provided.

The escape member 550 retracts the rotation shaft 132 of the roller 130 away from the nip N. The escape member 550 includes an escape member control portion 551, escape member arms 552, an escape member spring base 554, and an escape member hinge 555. The escape member 550 is assembled together with the guide member 560. The escape member control portion 551 makes contact with a sheet-feeding cassette control portion 113 (see FIG. 10) disposed on the sheet-feeding cassette 110 or a door control portion 103 (see FIG. 11) disposed at the door 102. The escape member arms 552 retract the rotation shaft 132 of the roller 130 from the transportation path by pushing the rotation shaft 132 in a negative direction along the x-axis. Both ends of the escape member spring 558 are supported by escape member spring bases 554 and 568 disposed on the escape member 550 and the guide member 560, respectively, and provide the elastic escape force for the rotation shaft 132 of the roller 130. The escape member hinge 555 is inserted into an escape member hinge groove 565 disposed on the guide member 560, and the escape member 550 rotates around the escape member hinge 555.

The guide member 560 includes the restriction groove 561, the roller groove 562, the escape member hinge groove 565, an escape member boss 566, a guide rib 567, and the escape member spring base 568.

The free end of the stopper arm 510 protrudes toward the transportation path through the restriction groove 561. When the front ends of extra sheets of paper moving simultaneously with the sheet of paper P are caught in the free end of the stopper arm 510, the extra sheets of paper push the stopper arm 510 in a downstream direction. As described above, a top boundary of the restriction groove 561 supports the stopper arm 510 from being pushed downstream by the extra sheets of paper. The roller 130 protrudes toward the transportation path through the roller groove 562. The escape member 550 is rotatably mounted onto the escape member boss 566. The guide rib 567 guides sheets of paper along the transportation path.

FIGS. 7 through 9 are cross-sectional views which explain, in sequence, the operations of the shutter arm 520 and the stopper arm 510.

FIG. 7 illustrates a state when the first sheet of paper P1 begins moving along the transportation path. In FIG. 7, the shutter arm 520 is positioned in the standby position. Thus, the stopper arm 510 is retracted from the transportation path. The pick up roller 120 frictionally engages the first sheet of paper P1 and transports the first sheet of paper P1 up the transportation path to the nip N. The first sheet of paper P1 entering the nip N moves continuously along the transportation path and pushes the end 523 of the shutter arm 520 into the second position.

FIG. 8 illustrates a state when the first sheet of paper P1 is passing through the nip N and a second sheet of paper P2 is moving along together with the first sheet of paper P1 in a multi-sheet feed. As shown in FIG. 8, the first sheet of paper P1 pushes the end 523 of the shutter arm 520 into the second position by the force of the front end of the first sheet of paper P1 moving along the transportation path. Although the torsion spring 528 generates an elastic return force in the direction of the x-axis which pushes the shutter arm 520 back towards the transportation path, the elastic return force is smaller than the normal force of the first sheet of paper P1 generated by the surface of the first sheet of paper P1 pushing against the shutter arm 520. Thus, the shutter arm 520 does not return to the first position and stays in the second position. When the shutter arm 520 swings to the second position, the protrusion cam 527*a* pushes the stopper arm 510 so that the stopper arm 510 protrudes toward the transportation path. The stopper arm 510 blocks the second sheet of paper P2 from moving simultaneously with the first sheet of paper P1 along the transportation path. Since the stopper arm 510 is supported by the restriction groove 561, and since the restriction groove 561 is integrally formed into the guide member 560, the stopper arm 510 overcomes the transportation force of the second sheet of paper P2 and prevents the second sheet of paper P2 from further movement along the transportation path.

FIG. 9 illustrates a state just before the second paper P2 passes through the nip N after the first sheet of paper P1 has already passed through the nip N. The torsion spring 528 elastically biases the shutter arm 520 back to the standby position. The escape cam 527*b* retracts the stopper arm 510 from the transportation path by pushing the escape cam 527*b*. After the first sheet of paper P1 passes through the nip N, the stopper arm 510 retracts from the transportation path and the second sheet of paper P2 resumes downstream movement along the transportation path.

Figure 10:
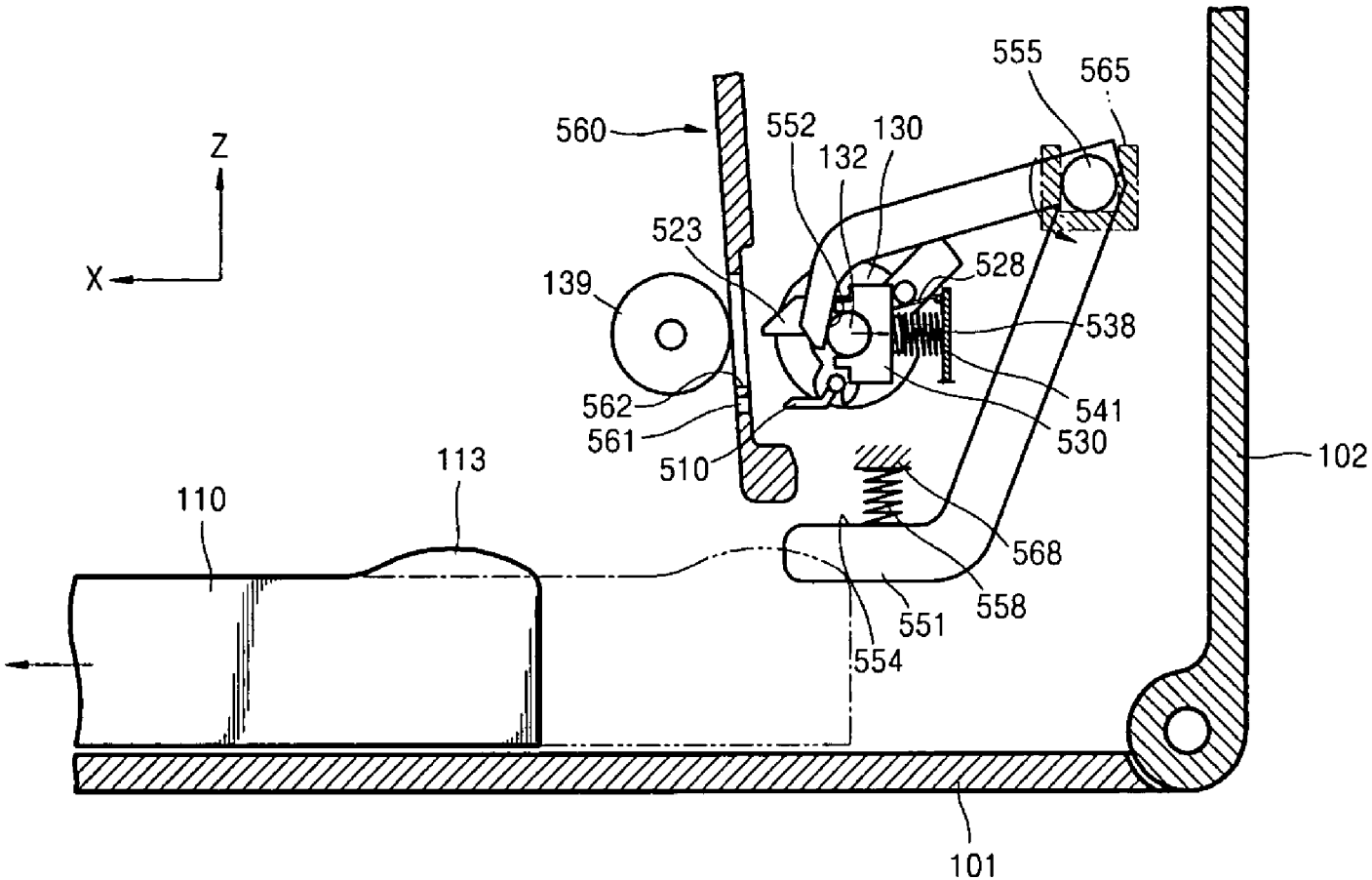
FIGS. 10 and 11 are cross-sectional views which illustrate the operation of the escape member shown in FIGS. 4 and 5

FIG. 10 illustrates an operational state of the escape member 550 when a user attaches or detaches the sheet-feeding cassette 110. The sheet-feeding cassette 110 illustrated by a solid line is in a state of being separated from the body 101 of the image forming apparatus 100. The sheet-feeding cassette 110 illustrated by a dashed-dotted line is in a state of being installed into the body 101. The escape member control portion 551, which contacts the sheet-feeding cassette control portion 113 formed on the sheet-feeding cassette 110, is released from the sheet-feeding cassette control portion 113 when the sheet-feeding cassette 110 is separated from the body 101. When the escape member spring 558 pushes the escape member 550, the escape member 550 swings around the escape member hinge 555 into an escape position. The escape member arms 552 push the rotation shaft 132 of the roller 130 in the negative direction of the x-axis. When the escape member arms 552 push the rotation shaft 132 of the roller of the roller 130 in the negative direction of the x-axis, the roller 130, the shutter arm 520, and the stopper arm 510 all move away from the transportation path of paper, making it easier to remove jammed paper and to attach and detach the shutter arm unit 500 to and from the body 101 of the image forming apparatus 100 without any interference from other constitutional parts.

Figure 11:
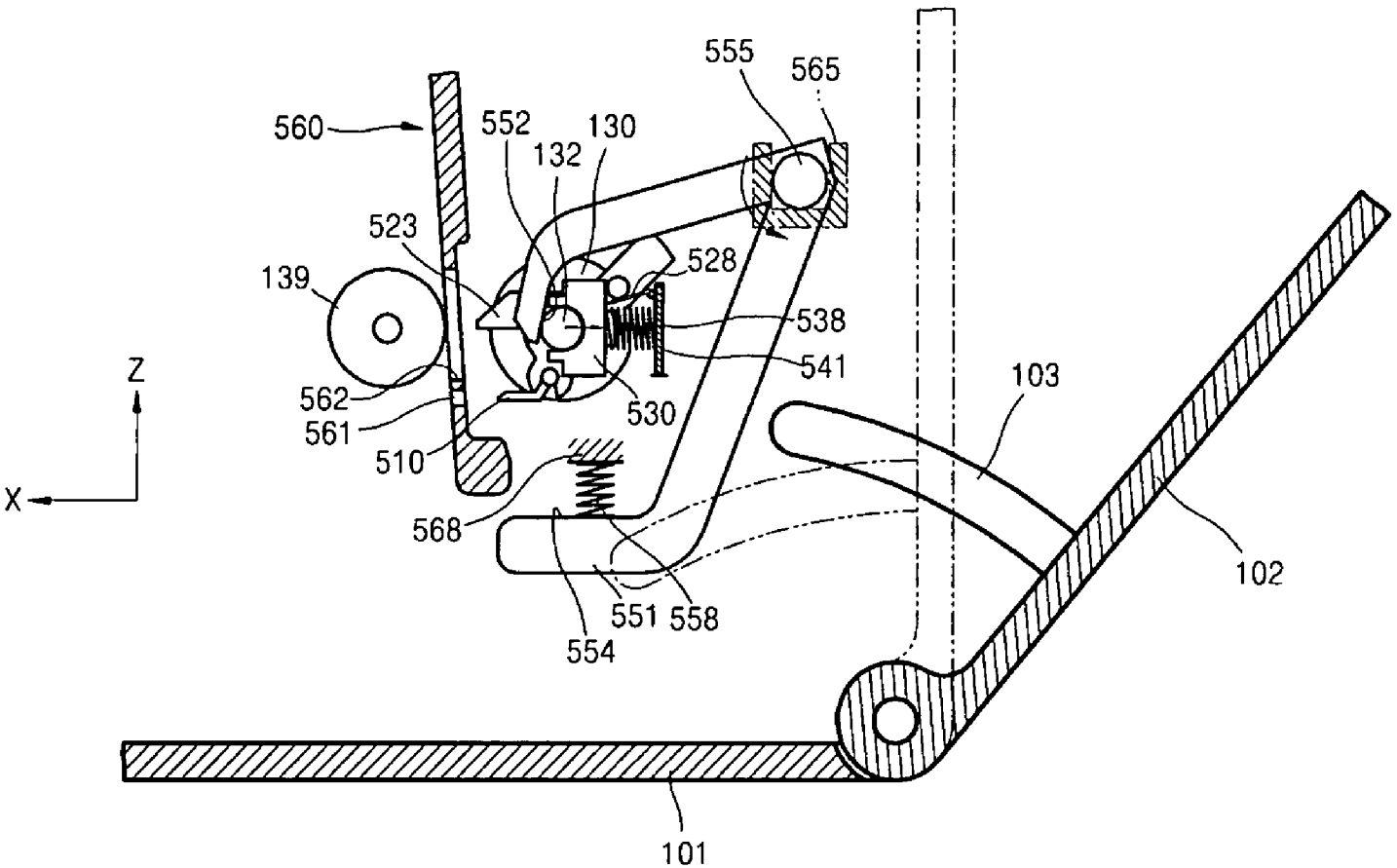

FIG. 11 illustrates the operation of the escape member 550 when a user opens and closes the door 102. The door 102 swings around a door hinge (not shown) and thereby opens and closes an area of the body 101 of the image forming apparatus 100. In FIG. 11, the door 102 illustrated by a solid line represents the door 102 in an open state, and the door 102 illustrated by a dashed-dotted line represents the door 102 in a closed state. When the door 102 is in a closed state, the door control portion 103, which is formed on the door 102, keeps the escape member control portion 551 in a locked position. When a user opens the door 102, the door control portion 103 swings open with the door 102. As a result, the escape member control portion 551 in contact with the door control portion 103 elastically rotates in a counter-clockwise direction due to the elastic force of the escape member spring 558. The escape member spring 558 pushes the escape member 550, the escape member 550 swings around the escape member hinge 555, and the escape member arms 552 move the rotation shaft 132 of the roller 130 in the negative direction of the x-axis.

According to aspects of the image forming apparatus of the present invention as described above, the stopper arm prevents a multi-sheet feed, the shutter arm and the stopper arm which are pushed by the front end of a sheet of paper have a simple structure, the increase in a return load of the shutter arm is prevented, the pair of ends of the shutter arm enables alignment of the front end of a sheet of paper moving along the transportation path, and the shutter arm unit may be disposed at any position on the transportation path.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus comprising:

a printing unit which prints an image onto a recording medium; a transportation path inside of the printing unit through which the recording medium is transported from a sheet-feeding cassette to a discharge tray, wherein a front end of the recording medium moves along the transportation path first; and a shutter arm unit, comprising:

a shutter arm which is at a first position where one end of the shutter arm protrudes toward the transportation path, and which moves to a second position when the shutter arm retracts from the transportation path when the shutter arm is pushed by the front end of the recording medium moving along the transportation path, and a stopper arm, formed on the shutter arm, which protrudes toward the transportation path when the shutter arm retracts to the second position and blocks a front end of at least a second recording medium moving simultaneously with the first recording medium along the transportation path, wherein the stopper arm comprises:

a free end which protrudes toward the transportation path when the shutter arm retracts to the second position; and a fixing end connected to the shutter arm, wherein the stopper arm is positioned upstream of the shutter arm.

2. The image forming apparatus of claim 1, wherein the stopper arm further comprises:

a hinge which connects the fixing end to the shutter arm, wherein the stopper arm rotates around the hinge.

3. The image forming apparatus of claim 2, wherein the shutter arm comprises a protrusion cam which makes the free end of the stopper arm protrude towards the transportation path by pushing the stopper arm towards the transportation path as the shutter arm swings to the second position.

4. The image forming apparatus of claim 3, wherein the shutter arm further comprises an escape cam which makes the free end retract from the transportation path by pushing the stopper arm away from the transportation path as the shutter arm returns to the first position.

5. The image forming apparatus of claim 4, wherein the protrusion cam and the escape cam control a range of rotation of the stopper arm as the stopper arm rotates freely around the hinge.

6. The image forming apparatus of claim 5, wherein the shutter arm unit further comprises:

a guide member which guides the recording medium along the transportation path; and a restriction groove formed in the guide member and opened toward the transportation path, wherein the stopper arm protrudes toward the transportation path through the restriction groove, an upper portion of the restriction groove blocks the stopper arm from moving in a direction along the transportation path, and the stopper arm blocks the front end of at least the second recording medium from moving simultaneously with the recording medium along the transportation path.

7. The image forming apparatus of claim 1, wherein the shutter arm unit further comprises another end, wherein the one end and the another end are spaced apart from each other, integrally formed to each other, and configured at the same height as each other from a bottom of the image forming apparatus, to align the front end of the recording medium as the recording medium moves along the transportation path.

8. The image forming apparatus of claim 1, further comprising:

a housing which houses the shutter arm unit; and a torsion spring connected to the shutter arm and the housing which elastically biases the shutter arm into the first position.

9. The image forming apparatus of claim 1, wherein the shutter arm unit further comprises a sensing portion which detects a moment when the recording medium contacts the shutter arm by sensing a swing position of the shutter arm.

10. The image forming apparatus of claim 9, wherein the sensing portion comprises:

a sensor arm integrally formed with the shutter arm; and an optical sensor disposed in a swing path of the sensor arm, which senses the swing position of the sensor arm.

11. An image forming apparatus comprising:

a printing unit which prints an image onto a recording medium;

a transportation path inside of the printing unit through which the recording medium is transported from a sheet-feeding cassette to a discharge tray, wherein a front end of the recording medium moves along the transportation path first; and a shutter arm unit, comprising:

any one of a pair of rollers which transport the recording medium by forming a nip in the transportation path where the rollers contact each other, a shutter arm which rotates around a rotation shaft of the rollers, wherein the shutter arm is at a first position when the shutter arm is elastically biased at the first position and one end of the shutter arm protrudes toward the transportation path, and wherein the shutter arm is at a second position when pushed by the front end of the recording medium, and a stopper arm disposed at the shutter arm which stops movement of at least a second recording medium moving simultaneously with the first recording medium along the transportation path by protruding toward the transportation path when the shutter arm swings to the second position, wherein the stopper arm comprises:

a free end which protrudes toward the transportation path when the shutter arm retracts to the second position; and a fixing end connected to the shutter arm, wherein the stopper arm is positioned upstream of the shutter arm.

12. The image forming apparatus of claim 11, wherein the stopper arm further comprises:

a hinge which connects the fixing end to the shutter arm, wherein the stopper arm rotates around the hinge.

13. The image forming apparatus of claim 12, wherein the shutter arm comprises a protrusion cam which makes the free end of the stopper arm protrude towards the transportation path by pushing the stopper arm towards the transportation path as the shutter arm swings to the second position.

14. The image forming apparatus of claim 13, wherein the shutter arm further comprises an escape cam which makes the free end retract from the transportation path by pushing the stopper arm away from the transportation path as the shutter arm returns to the first position.

15. The image forming apparatus of claim 14, wherein the protrusion cam and the escape cam control a range of rotation of the stopper arm as the stopper arm rotates freely around the hinge.

16. The image forming apparatus of claim 15, wherein the shutter arm unit further comprises:

a guide member which guides the recording medium along the transportation path; and a restriction groove formed in the guide member and opened toward the transportation path, wherein the stopper arm protrudes toward the transportation path through the restriction groove, an upper portion of the restriction groove blocks the stopper arm from moving in a direction along the transportation path, and the stopper arm blocks a front end of at least the second recording medium from moving simultaneously with the recording medium along the transportation path.

17. The image forming apparatus of claim 11, wherein the shutter arm unit further comprises:

a pair of bosses which support two corresponding ends of the rotation shaft of the rollers; and a boss spring which elastically biases the pair of bosses toward the nip.

18. The image forming apparatus of claim 17, wherein the shutter arm unit further comprises an escape member, comprising:

a parallel section positioned parallel to the rotation shaft of the rollers;

a pair of escape member arms fixed to the parallel section which are rotatable to an escape position where the pair of escape member arms push the rotation shaft of the roller away from the transportation path;

an escape member control portion fixed to the parallel section; and an escape member spring which elastically presses the escape member control portion to cause a rotation of the parallel section which causes the pair of escape member arms to rotate towards the escape position.

19. The image forming apparatus of claim 18, further comprising:

a body in which the printing unit is mounted;

a door which opens and closes the body and has a door control portion; and a sheet-feeding cassette which is attachable to and detachable from the body and which stores sheets of recording media, wherein the escape member control portion leans against either the sheet-feeding cassette when the sheet-feeding cassette is installed inside the body or the door control portion when the door is closed, preventing the escape member spring from pushing the escape member control portion into an escape position.

20. The image forming apparatus of claim 11, further comprising a transfer roller, wherein the shutter arm unit is located in between the sheet-feeding cassette and the transfer roller on the transportation path.

21. The image forming apparatus of claim 11, further comprising a transfer roller, wherein one of the rollers in the pair of rollers of the shutter arm unit is the transfer roller.

22. The image forming apparatus of claim 11, further comprising:

a transfer roller; and a fixer, comprising:

a heating roller, and a pressing roller, wherein the shutter arm unit is located in between the transfer roller and the fixer on the transportation path.

23. The image forming apparatus of claim 11, further comprising a fixer, comprising:

a heating roller, and a pressing roller, wherein one of the rollers in the pair of rollers is the heating roller or the pressing roller.

24. The image forming apparatus of claim 11, wherein the shutter arm unit is located in between a fixer and a discharge roller on the transportation path.

25. An image forming apparatus, comprising:

a printing unit which prints an image onto a recording medium;

a transportation path inside of the printing unit through which the recording medium is transported from a sheet-feeding cassette to a discharge tray, wherein a front end of the recording medium moves along the transportation path first; and a shutter arm unit, comprising:

a pair of rollers which transport the recording medium by forming a nip in the transportation path where the rollers contact each other;

a shutter arm which rotates around a rotation shaft of the rollers, wherein the shutter arm is at a first position where one end of the shutter arm protrudes toward the transportation path, and which moves to a second position when the shutter arm retracts from the transportation path when the shutter arm is pushed by the front end of the recording medium moving along the transportation path;

a stopper arm connected to the shutter arm which protrudes toward the transportation path when the shutter arm retracts to the second position and blocks a front end of at least a second recording medium moving simultaneously with the first recording medium along the transportation path;

a pair of bosses which support two corresponding ends of the rotation shaft of the rollers;

a boss spring which elastically biases the pair of bosses toward the nip; and an escape member, comprising:

a parallel section positioned parallel to the rotation shaft of the rollers;

a pair of escape member arms fixed to the parallel section which are rotatable to an escape position where the pair of escape member arms push the rotation shaft of the rollers away from the transportation path;

an escape member control portion fixed to the parallel section; and an escape member spring which elastically presses the escape member control portion to cause a rotation of the parallel section which causes the pair of escape member arms to rotate towards the escape position.

* * * * *